US010743626B2

(12) United States Patent
Cho et al.

(10) Patent No.: US 10,743,626 B2
(45) Date of Patent: Aug. 18, 2020

(54) UMBRELLA DRAWING-IN BY WINDING

(71) Applicant: Chin-Hsing Cho, Taiwan (CN)

(72) Inventors: Chin-Hsing Cho, Taiwan (CN); Wei-Jen Chen, Taiwan (CN); Chang-Cheng Lin, Taiwan (CN); Mei-Ling Chen, Taiwan (CN); Tsao-Yuan Fu, Taiwan (CN)

(73) Assignee: Chin-Hsing Cho, Taiwan (CN)

( * ) Notice: Subject to any disclaimer, the term of this patent is extended or adjusted under 35 U.S.C. 154(b) by 0 days.

(21) Appl. No.: 16/080,658

(22) PCT Filed: Apr. 27, 2018

(86) PCT No.: PCT/CN2018/084767
§ 371 (c)(1),
(2) Date: Aug. 28, 2018

(87) PCT Pub. No.: WO2019/052187
PCT Pub. Date: Mar. 21, 2019

(65) Prior Publication Data

US 2019/0254395 A1 Aug. 22, 2019

(30) Foreign Application Priority Data

Sep. 18, 2017 (CN) ..... 2017 2 1195648 U

(51) Int. Cl.
*A45B 25/18* (2006.01)
*A45B 25/14* (2006.01)
(Continued)

(52) U.S. Cl.
CPC ..... *A45B 25/18* (2013.01); *A45B 25/02* (2013.01); *A45B 25/12* (2013.01); *A45B 25/14* (2013.01); *A45B 2025/003* (2013.01)

(58) Field of Classification Search
CPC .... A45B 25/18; A45B 2025/003; A45B 25/14
See application file for complete search history.

(56) References Cited

U.S. PATENT DOCUMENTS 6,079,430 A * 6/2000 Yamamoto ..... A45B 25/18 135/15.1
2008/0121255 A1* 5/2008 Lin ..... A45B 25/24 135/15.1

(Continued)

FOREIGN PATENT DOCUMENTS

CN 1640342 7/2005
CN 201663985 12/2010

(Continued)

OTHER PUBLICATIONS

English translation of CN 205143756 U from espacenet.com.*

(Continued)

*Primary Examiner* — David R Dunn
*Assistant Examiner* — Danielle Jackson
(74) *Attorney, Agent, or Firm* — JCIPRNET

(57) ABSTRACT

An umbrella drawing-in by winding includes an umbrella fabric, a frame, a shaft and retracting assemblies. The frame includes a notch, a runner and a rib support set. A top end of the rib support set is secured at a top end of the shaft via the notch. A bottom end of the rib support set is secured on the shaft via the runner. The umbrella fabric has folds and is secured on the frame. The retracting assemblies are secured on one side of the folds.

8 Claims, 5 Drawing Sheets

(51) Int. Cl.

| | |
|---|---|
| ***A45B 25/12*** | (2006.01) |
| ***A45B 25/02*** | (2006.01) |
| *A45B 25/00* | (2006.01) |

(56) References Cited

U.S. PATENT DOCUMENTS

| | | | | |
|---|---|---|---|---|
| 2009/0139555 | A1 | 6/2009 | Kharag | |
| 2018/0000211 | A1* | 1/2018 | Nagelberg ..... | A45B 25/08 |

FOREIGN PATENT DOCUMENTS

| | | | | |
|---|---|---|---|---|
| CN | 102429418 | | | 5/2012 |
| CN | 205143756 | U | * | 4/2016 |
| CN | 205658492 | U | * | 10/2016 |
| CN | 106174943 | A | * | 12/2016 |
| CN | 206025474 | | | 3/2017 |
| CN | 206137417 | U | * | 5/2017 |
| TW | M348508 | U | * | 1/2009 |

OTHER PUBLICATIONS

English translation of CN 106174943 A from espacenet.com.*
English translation of CN 205658492 U from espacenet.com.*
English translation of CN 206137417 U from espacenet.com.*
"International Search Report (Form PCT/ISA/210)", dated Jul. 31, 2018, pp. 1-5.

* cited by examiner

UMBRELLA DRAWING-IN BY WINDING

CROSS-REFERENCE TO RELATED APPLICATION

This is a 371 application of the International PCT application serial no. PCT/CN2018/084767, filed on Apr. 27, 2018, which claims the priority benefits of China Application No. 201721195648.4, filed on Sep. 18, 2017. The entirety of each of the above-mentioned patent applications is hereby incorporated by reference herein and made a part of this specification.

FIELD OF THE INVENTION

This invention relates to the field of umbrella, and in particular to an umbrella drawing-in by winding.

DESCRIPTION OF RELATED ART

A folding umbrella is drawn in manually, and the folds will appear more or less due to the use of umbrella; therefore, it is required to put the umbrella fabric in order manually, and then retract and tightly bind it with a tie band, and finally place the umbrella into a pouch; however, it is quite time-consuming to draw the umbrella in, and it is unaesthetic if drawn-in in such manner. If the umbrella is not drawn in, it will not only make the umbrella fabric dirty, but also reduce its service life.

SUMMARY OF THE INVENTION

The technical issue to be resolved by the invention lies in the provision of an umbrella drawing-in by winding to solve the problem that it is complicated to draw in the umbrella.

This invention achieves the target in such manner that it provides an umbrella drawing-in by winding, including an umbrella fabric, a frame, a shaft and a retracting assembly. The frame includes a notch, a runner and a rib support set. A top end of the rib support set is secured at a top end of the shaft via the notch. A bottom end of the rib support set is secured on the shaft via the runner. The umbrella fabric has folds and is secured on the frame. The retracting assemblies are secured on one side of the folds.

Further, the folds are straight-line folds centering around the umbrella fabric and extending outward as well as arraying in a circular manner, circular umbrella folds set on the umbrella fabric and taking a central point as a center of circle, and/or support folds secured on supporters of the rib support set.

Further, the umbrella is a triple-fold umbrella. A number of the circular umbrella fabric is two. The retracting assemblies include an internal retracting piece, a medium retracting piece and an external retracting piece. The internal retracting piece is set on the umbrella fabric inside an innermost circular umbrella fold. The medium retracting piece is set on the umbrella fabric between the two circular umbrella folds. The external retracting piece is set on the umbrella fabric outside an outermost circular umbrella fold.

Further, the retracting assemblies are arc-shaped retracting assemblies.

Further, the retracting assemblies are solid retracting assemblies or hollow restricting assemblies.

Further, the retracting assemblies are PU retracting piece assemblies, TPU retracting piece assemblies, PET retracting piece assemblies, PE retracting piece assemblies, PP retracting piece assemblies, ABS retracting piece assemblies, PVC retracting piece assemblies or silicone retracting piece assemblies.

Further, the rib support set is a triple-fold rib support set, a double-fold rib support set or a quadruple-fold rib support set.

Further, the umbrella is a manually-open umbrella, an automatically-open umbrella or an electrically-open umbrella.

Further, the umbrella is a rain umbrella or a sunshade.

Further, it also includes a tie band. The tie band is set on an outside surface of the umbrella fabric. The tie band is used to fix the umbrella fabric after the umbrella is drawn in and folded.

The invention has following advantages: different from an existing umbrella that is cumbersome to draw in and that requires to putting an umbrella fabric orderly for retracting and binding for storage, which makes people spend a lot of time in retracting the umbrella manually. The umbrella drawing-in by winding in this technical scheme, by setting the retracting assemblies on an internal surface of the umbrella fabric improves a rigidity of a section of the umbrella fabric with retracting assembly, thus making the umbrella fabric be neat at such position and become much easier to be arranged and retracted, and therefore to achieve auto-retraction of the umbrella fabric, and quick-arrangement of the umbrella fabric.

DESCRIPTION OF REFERENCE NUMBER

Detailed Description of the Preferred Embodiments

Figure 1:
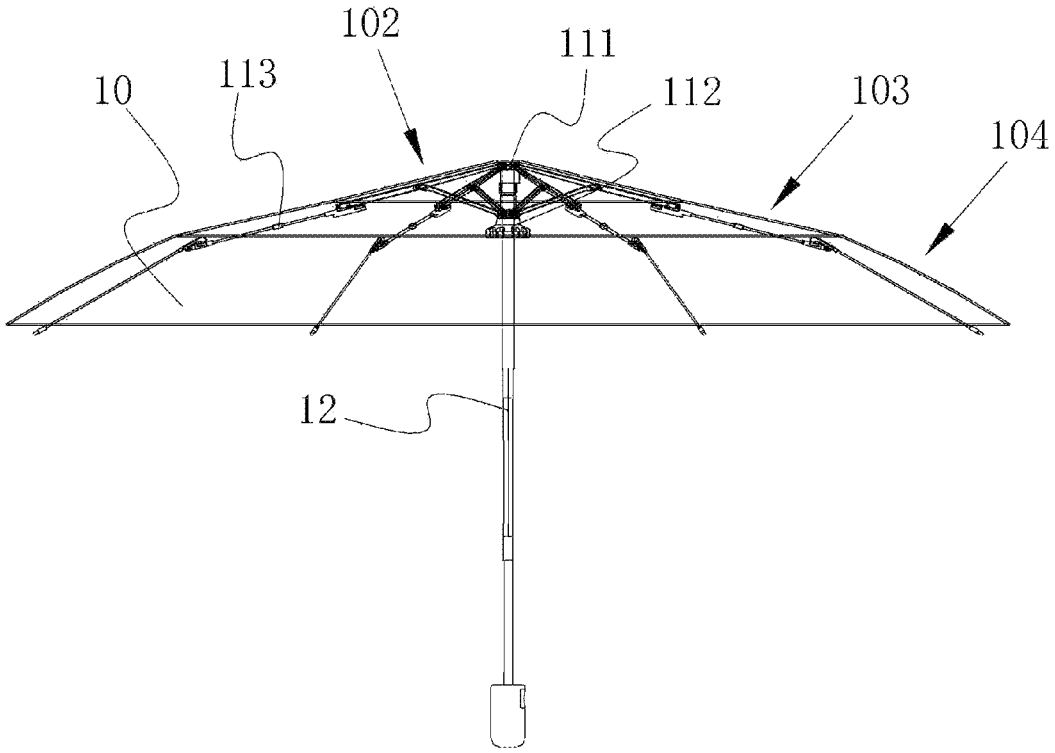
FIG. 1 is a schematic diagram of an umbrella drawing-in by winding in a preferred embodiment of this invention.
Figure 2:
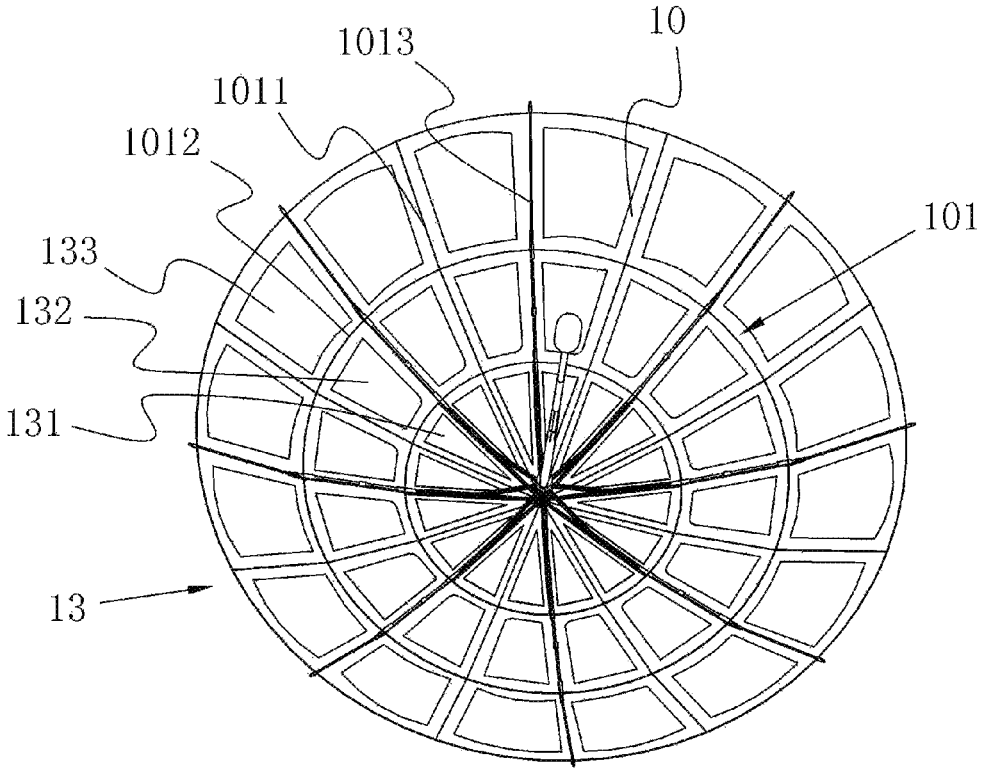
FIG. 2 is a structural diagram of the umbrella drawing-in by winding in the preferred embodiment of this invention.

In order to describe the related art, structural features, accomplished purpose and performance in details, the description is made by combining the preferred embodiments and drawings.

Referring to FIG. 1 to FIG. 7, this invention provides an umbrella drawing-in by winding, including an umbrella fabric 10, a frame 11, a shaft 12 and retracting assemblies 13. The frame 11 includes a notch 111, a runner 112 and a rib support set 113. A top end of the rib support set 113 is secured at a top end of the shaft 12 via the notch 111. A bottom end of the rib support set 113 is secured on the shaft 12 via the runner 112. The umbrella fabric 10 has folds 101 and is secured on the frame 11. The retracting assemblies 13 are secured on one side of the folds.

The umbrella drawing-in by winding in this preferred embodiment can retract the umbrella by the retracting assemblies within the umbrella when people draw in the umbrella, thus people do not need to put the umbrella in order manually. To be specific, the umbrella in this preferred embodiment includes the umbrella fabric, the frame, the shaft and the retracting assemblies. The frame is secured to the top end of the shaft via the notch. A lower end of the frame is connected to the shaft via the runner; therefore, supporters of the frame can fold or open together with the runner, so the shaft can be a telescopic pole or a straight bar. The telescopic pole can achieve the contracting of the shaft and the folding of the umbrella support. The straight bar can draw the frame directly to the shaft. The umbrella fabric is secured on the supporter of the frame by tying with threads or ropes. The supporter can be a straight-line, double-fold, triple-fold or folded frame support. Therefore, the way to lay out the winding body on the umbrella cloth can vary greatly. For example, when the umbrella is configured as to the foldable umbrella, in addition to straight-line folds and supporting folds, there are also the circular folds. By these folds, the umbrella fabric can be divided into different zones. For different folding umbrellas, the zoning is also different based on the numbers of folding. Three zones of the triple-fold umbrella are divided into an internal fabric 102, a medium fabric 103 and an external fabric 104 from inside to outside. The straight umbrella does not need to be zoned.

Figure 4:
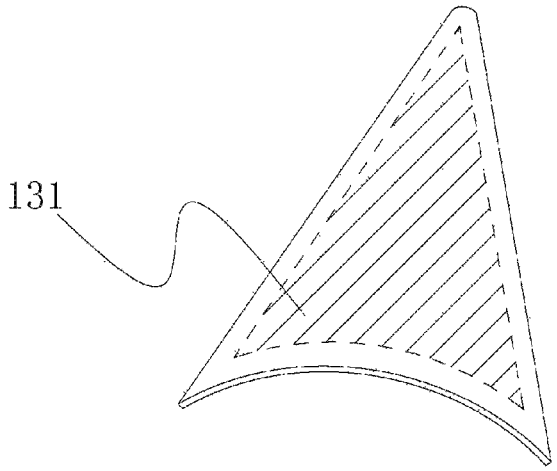
FIG. 4 is a schematic diagram of an internal retracting piece of the umbrella drawing-in by winding in the preferred embodiment of this invention.
Figure 5:
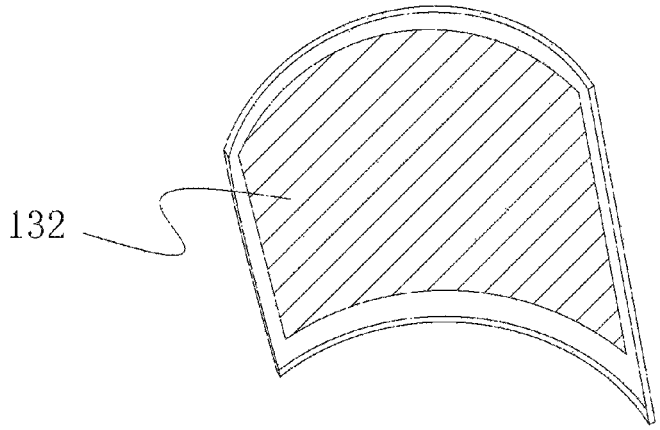
FIG. 5 is a schematic diagram of a medium retracting piece of the umbrella drawing-in by winding in the preferred embodiment of this invention.
Figure 6:
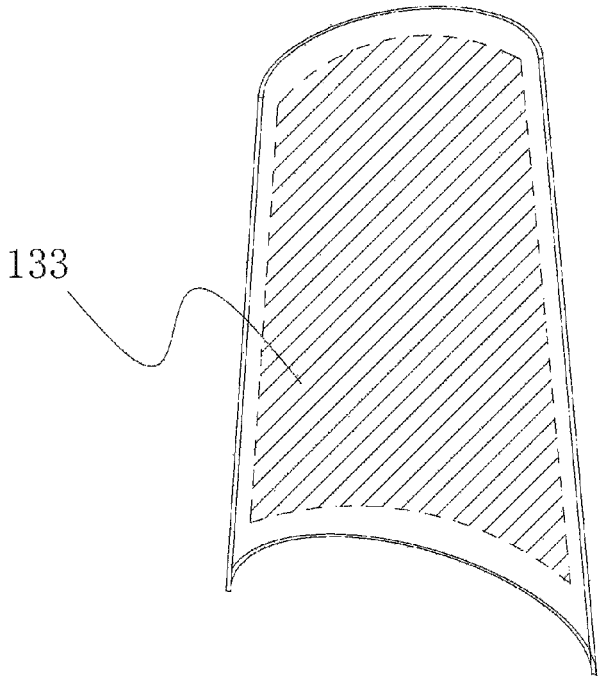
FIG. 6 is a schematic diagram of an external retracting piece of the umbrella drawing-in by winding in the preferred embodiment of this invention.
Figure 7:
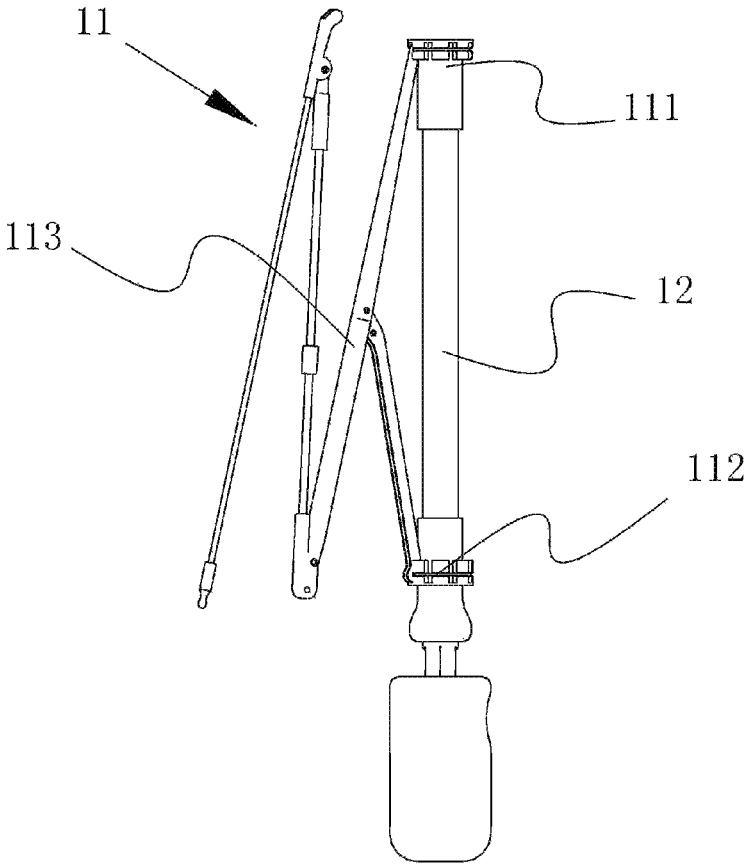
FIG. 7 is a structural diagram of an umbrella frame of the umbrella drawing-in by winding in the preferred embodiment of this invention.

Take the triple-fold umbrella as an example for illustration, as shown in FIG. 1, FIG. 2, FIG. 3 and FIG. 7, other kinds of umbrella can be configured as a same approach as the triple-fold umbrella. A distribution of the folds can be made in following manner: straight-line fold 1011 refers to that centers around the umbrella fabric, extends outward and arraying in a circular manner. The straight-line folds can be arranged at a central position between the supporter and supporter of the frame. The circular umbrella fold 1012 refers to that takes a central point of the umbrella fabric as a center of circle. The circular umbrella fold can be located at a turning point of the supporter of the frame. The supporting fold 1013 refers to that at the supporter of the rib support set. If the umbrella is a triple-fold umbrella, a number of the circular umbrella fabric is two. As shown in FIG. 4, FIG. 5 and FIG. 6, the retracting assemblies includes an internal retracting piece 131, a medium retracting piece 132 and an external retracting piece 133. The internal retracting piece is set on the umbrella fabric inside an innermost circular umbrella fold. The medium retracting piece is set on the umbrella fabric between the two circular umbrella folds. The external retracting piece is set on the umbrella fabric outside an outermost circular umbrella fold. That is, the internal retracting piece is set on the internal fabric, the medium retracting piece is set on the medium fabric, and the external retracting piece is set on the external fabric.

The internal retracting piece can be set based on size of the internal fabric. If an area of the internal fabric is too small, the internal retracting piece can be canceled, or can be made by the means of coated printing. The external retracting piece can be considered based on a light-weight of design. If the setting of the external retracting piece on the external fabric is canceled, or the external retracting piece is made by means of coated printing, thus making the external fabric light-weighted. If the external retracting piece is canceled, when retracting the umbrella, the medium retracting piece is used to drive the drawing-in of the external fabric, thus drawing in the umbrella fabric automatically as well as arranging the umbrella fabric quickly. The coated printing is a method to make composite material (film) to coat the paste polymer, molten polymer or polymer melt on the paper, cloth, plastic film. For example, in addition to the roller painting, spraying, powder coating, etc., the other methods include the blade coating method, which is to make the artificial leather by scraping out the PVC paste on the fabric base, the cast coating method, which is to paint the casting onto the paper, the extrusion coating method, which is to paint the extrusion film onto the base material, the brush painting method, which is to paint the coating evenly on the base material, and the coating method can be dry coating, blade coating, digital printing or thermal transfer printing etc. In this preferred embodiment, the retracting piece is made directly on the umbrella fabric by means of coated printing. As the coating can achieve the target of lightweight, it can also enhance the rigidity of a partial of the umbrella fabric, and an arc structure of the retracting piece makes the umbrella fabric neatly when drawing in the umbrella fabric, which only requires binding by a rope or a tie band. The retractor can also be made of PU, TPU, silica gel, plastic, PET, PE, PP, ABS or PVC and other materials. After complete initial shaping, the retractor can be shaped and rolled by means of hot roll-pressing, thus thermosetting the retracting body. The way of thermosetting can be UV curing, thermosetting or spontaneous curing, etc. And finally attaching the molded the retractor, The attaching method can be manual attaching, automatic attaching, hot roll-press or sewing attaching, etc., to allow the retractor to be attached to the umbrella fabric. When drawing in the umbrella, the retractor can draw in automatically. At the same time, the strength of the umbrella fabric at the position with the retractor is improved to some extent; therefore, it can maintain flat while drawing in the umbrella fabric, thus placing the umbrella fabric in order quickly.

Figure 3:
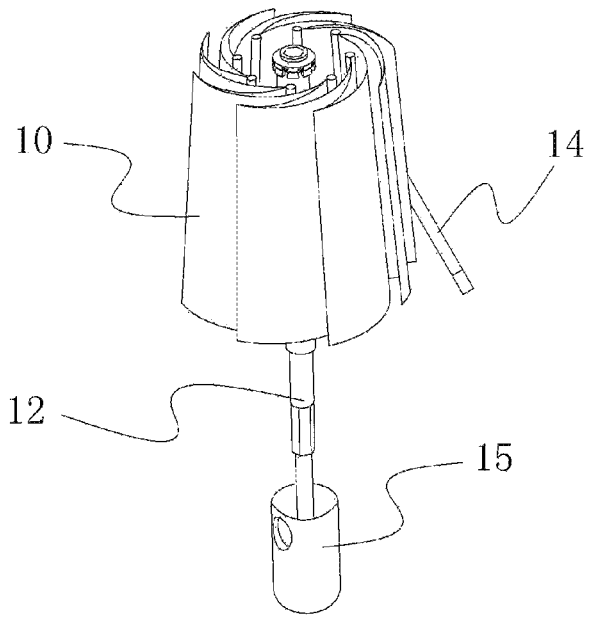
FIG. 3 is a schematic diagram of the umbrella drawing-in by winding under a retracting state in the preferred embodiment of this invention.

The retracting assembly in this preferred embodiment is in an arc shape, as shown in FIG. 3, the arc retractor can make the contractive umbrella fabric in an arc shape, so that the umbrella fabric of different layers can stack up with each other through the arc retractor; therefore, the umbrella fabric can draw in automatically based on the arc retractor while drawing in the umbrella. In such case, people only need to bind the umbrella with ropes or the tie band, thereby drawing in the umbrella automatically. The retracting assembly can be a solid retracting assembly or a hollow retracting assembly. The retracting piece assembly is a PU retracting piece assembly, a TPU retracting piece assembly, a PET retracting piece assembly, a PE retracting piece assembly, a PP retracting piece assembly, an ABS retracting piece assembly, a PVC retracting piece assembly or a silicone retracting piece assembly. PU, the abbreviation of polyurethane (with its English name as: polyurethane) refers to the polyurethane material, which is a high-molecular material. TPU (with its English name as: Thermoplastic polyurethanes) refers to the thermoplastic polyurethanes. PET (with its English name as: Polyethylene terephthalate) refers to the polyethylene terephthalate. PE (with its English name as: polyethylene) is a kind of thermoplastic resin obtained by aggregating the ethylene. PP (with its English name as: Polypropylene) refers to the polypropylene, which is also a thermoplastic resin by aggregating the propylene. ABS (with its English name as: acrylonitrile-butadiene-styrene copolymer) is a kind of synthetic resin. PVC (with its English name as: is polyvinyl chloride) refers to the compound polyvinyl chloride in terms of chemical sector. As a result, the molded fixing assembly can be made by different materials. Meanwhile, the molded fixing assembly can be made of softer materials, thus avoiding the molded fixing assembly from cutting into the umbrella cloth, or it may lead to the cuts to the users by such molded fixing assembly. Furthermore, the molded fixing assembly can be set on the umbrella cloth by fitting or coating, and the molded fixing assembly can be set a certain shape according to the different positions of the umbrella cloth, thus making the thickness of the umbrella different; therefore, a hardness of the umbrella at different positions varies, so that it will be faster for people to draw in the folding umbrella. An external surface or an internal surface of the umbrella can be coated fully by the materials similar to PU, thus preventing the UV (with its English name as Ultraviolet, namely the UV light).

The rib support set is a triple-fold rib support set, a double-fold rib support set, a quadruple-fold rib support set or a straight-bar rib support set. The umbrella is a manually-open umbrella, an automatically-open umbrella or an electrically-open umbrella. The umbrella is a rain umbrella or a sunshade. As shown in FIG. 3, it also includes a tie band 14. The tie band is set on an outside surface of the umbrella fabric. The tie band is used to fix the umbrella fabric after the umbrella is drawn in and folded. The shaft can be set with an umbrella handle 15, through which people can hold the umbrella better. The self-opening umbrella or the electric umbrella can be set with a push button disposed on the umbrella handle, by which the opening/closing of the umbrella can be controlled so as to facilitate the use of umbrella by people. After the umbrella is drawn-in and folded, the tie band is used to bind the umbrella, thus placing the umbrella into the umbrella bag.

It should be noted that, in this article, the term related to the first, the second and other similar relationship is only to distinguish one entity or operation and another entity or operation, but necessarily requires or imply that these entities or operations have such actual relationship or order. In addition, the term "comprising", "including" or any other variants intends to cover a non-exclusive inclusion; therefore, the process, the method, the material or the terminal device containing a series of elements can not only include those elements, but also other elements that are not explicitly listed herein, or the inherent elements of such process, method, material or terminal device. In the absence of more restrictions, the elements restricted by the statement of "comprising . . . " or "including . . . " do not exclude other elements contained in the process, method, material or terminal device of the elements. In addition, the term "greater than", "less than", "more than" or others shall be construed as non-inclusion of the figure per se; "above", "below", "under" or others can be construed as inclusion of the figure per se.

Although the embodiments have been described above, once those skilled in the art understand basic creative concept, they can make additional modification and alteration for these embodiments; therefore, the above description is only the embodiments of the invention, but not intended to limit the scope of the patent protection of this invention, any equivalent structure or equivalent process modification used according to the contents of the specification and accompanying drawings in this invention, no matter whether it is directly or indirectly used in any other related technical field, should be included within the scope of patent protection herein.

What is claimed is:

1. An umbrella drawing-in by winding, comprising an umbrella fabric, a frame, a shaft and retracting assemblies, wherein the frame includes a notch, a runner and a rib support set, the rib support set has a first end portion and a second end portion, the first end portion is secured at a top end of the shaft via the notch, and the second end portion is slidably secured on the shaft via the runner, the umbrella fabric has folds and is secured on the frame, and the retracting assemblies are secured on one side of the folds, wherein the retracting assemblies are arc-shaped retracting assemblies and each of the retracting assemblies has a solid structure, and an outline of the retracting assemblies is conformal to an outline of the umbrella fabric, wherein the rib support set is foldable between a retracted state and an expanded state, when the rib support set is in the expanded state, each of the retracting assemblies is uncovered, and when the rib support set is in the retracted state, the retracting assemblies are stacked up with each other, and different layers of the umbrella fabric being arc-shaped and are stacked up with each other, wherein the umbrella fabric surrounds an axis and has a central point disposed on the axis, the folds include circular umbrella folds that surround the axis and take the central point as a center of circle, the umbrella is a triple-fold umbrella, a number of the circular umbrella folds is two, the retracting assemblies comprise a medium retracting piece, the medium retracting piece is set on the umbrella fabric between the two circular umbrella folds, and the medium retracting piece has an arc structure and the retracting assemblies are made of non-metal material.

2. An umbrella drawing-in by winding according to claim 1, wherein the folds include extension folds that extend outward from the central point to a periphery of the umbrella fabric and each of the extension folds is disposed between supporters of the rib support set, and supporting folds that extend outward from the central point to the periphery of the umbrella fabric and correspond in position to the supporters of the rib support set.

3. An umbrella drawing-in by winding according to claim 2, wherein the retracting assemblies comprise an internal retracting piece and an external retracting piece, wherein the internal retracting piece is set on the umbrella fabric inside an innermost circular umbrella fold, and the external retracting piece is set on the umbrella fabric outside an outermost circular umbrella fold.

4. An umbrella drawing-in by winding according to claim 1, wherein the retracting assemblies include PU retracting assemblies, TPU retracting assemblies, PET retracting assemblies, PE retracting assemblies, PP retracting assemblies, ABS retracting assemblies, PVC retracting piece assemblies or silicone retracting assemblies.

5. An umbrella drawing-in by winding according to claim 1, wherein the rib support set is a triple-fold rib support set, a double-fold rib support set or a quadruple-fold rib support set.

6. An umbrella drawing-in by winding according to claim 1, wherein the umbrella is a manually-openable umbrella, an automatically-openable umbrella or an electrically-openable umbrella.

7. An umbrella drawing-in by winding according to claim 1, wherein the umbrella is a rain umbrella or a sunshade.

8. An umbrella drawing-in by winding according to claim 1, further comprising a tie band, wherein the tie band is set on an outside surface of the umbrella fabric, and the tie band is used to fix the umbrella fabric after the umbrella is drawn in and folded.

* * * * *